US005458291A

United States Patent [19]

Brusko et al.

[11] Patent Number: 5,458,291

[45] Date of Patent: Oct. 17, 1995

[54] FLUID APPLICATOR WITH A NONCONTACTING DIE SET

[75] Inventors: Paul S. Brusko, Flowery Branch; Scott R. Miller, Boswell; Alan R. Ramspeck, Cumming, all of Ga.

[73] Assignee: Nordson Corporation, Westlake, Ohio

[21] Appl. No.: 214,354

[22] Filed: Mar. 16, 1994

[51] Int. Cl.[6] ..... B05B 7/08; B05B 7/16

[52] U.S. Cl. ..... 239/423; 239/433; 239/568

[58] Field of Search ..... 239/568, 433, 239/429, 424.5, 424, 423, 418, 135, 299, 296; 425/7, 72.2

[56] References Cited

U.S. PATENT DOCUMENTS

| | | | |
|---|---|---|---|
| Re. 33,481 | 12/1990 | Ziecker et al. | 239/298 |
| 4,199,675 | 4/1980 | Sharpless | 219/305 |
| 4,295,809 | 10/1981 | Mikami et al. | 425/72.2 |
| 4,465,922 | 8/1984 | Kolibas | 219/304 |
| 4,476,165 | 10/1984 | McIntyre | 427/258 |
| 4,687,137 | 8/1987 | Boger et al. | 239/124 |
| 4,720,252 | 1/1988 | Appel et al. | 425/80.1 |
| 4,774,109 | 9/1988 | Hadzimihalis et al. | 427/286 |
| 5,145,689 | 9/1992 | Allen et al. | 425/72.2 |
| 5,209,410 | 5/1993 | Wichmann et al. | 239/568 X |
| 5,236,641 | 8/1993 | Allen et al. | 264/40.1 |
| 5,269,670 | 12/1993 | Allen et al. | 425/72.2 |
| 5,354,378 | 10/1994 | Hauser et al. | 239/568 X |

*Primary Examiner*—Andres Kashnikow
*Assistant Examiner*—Lesley D. Morris
*Attorney, Agent, or Firm*—Wood, Herron & Evans

[57] ABSTRACT

A fluid applicator having a multi-zone noncontacting die set for dispensing a selected plurality of thin flat fiberized adhesive streams as uniform rectangular strips of adhesive on a substrate. The die set uses shims to establish the fiberizing air slot, and the adhesive dispensing and fiberizing air shims have tapered tabs to provide improved coating edge control. The fiberizing air die also has simplified fiberizing air flow, and the die set includes a mechanism for clamping the die set together which is especially suited for a multi-zone die set. The fluid applicator includes a manifold heater with a simplified and improved air flow, and a universal adhesive manifold.

18 Claims, 7 Drawing Sheets

FLUID APPLICATOR WITH A NONCONTACTING DIE SET

BACKGROUND OF THE INVENTION

The present invention relates generally to the area of fluid applicators and more particularly to a fluid applicator with a noncontacting die for fiberizing a flat fluid stream and applying the fiberized fluid stream as thin coating strip with sharply defined uniform edges on a substrate.

Hot melt thermal plastic adhesives have been widely used in industry for adhering many types of products and are particularly useful in applications where quick setting time is advantageous. Further, in many applications, the adhesive must be sufficiently thinly applied so that its presence is not apparent on the opposite side of the substrate. In those applications several different designs of fluid applicators have been developed. For example, the adhesive may be dispensed as a straight adhesive bead which is then swirled by air passing through air jets circumferentially spaced around the adhesive bead. An applicator of that type is disclosed in U.S. Pat. No. Re. 33,481 issued to the assignee of the present invention. Fluid applicators may also contain contacting dies which are effective to spread extruded streams of adhesive in predetermined patterns across a substrate. An example of a contacting die is disclosed in U.S. Pat. No. 4,687,137 also owned by the assignee of the present invention.

More recent applicators are of a noncontacting die design, an example of which is disclosed in U.S. patent application Ser. No. 07/910,784 which is assigned to the same assignee as the present application. The die includes an adhesive dispensing die with a dispensing zone, or slot, terminating at a dispensing die outlet. The die further includes fiberizing air dies mounted to the die to form fiberizing slots arranged adjacent to and on each side of the dispensing die outlet. The slotted die extrudes a continuous flat stream of hot melt adhesive through the dispensing die slot. Simultaneously therewith, hot air is dispensed through the adjacent fiberizing die slots. The hot air impinges upon and tears or separates the continuous flat stream of extruded adhesive into a discontinuous or fiberized stream of hot melt adhesive. The fiberized adhesive stream is then applied as a thin uniform coating on a substrate. The fiberizing air may be activated, or turned on, in each fiberizing slot in any combination with the adhesive dispensing cycle to obtain the desired shape and spread or control of the fiberized adhesive stream to be applied as a thin coat to the substrate.

The above described die set includes a pair of dispensing dies which are joined together with a dispensing shim therebetween to form the dispensing die slot through which the adhesive is dispensed. Each of a pair of fiberizing dies is attached to a respective one of the dispensing dies. Each fiberizing die has two surfaces which intersect to form a corner of the fiberizing die and which interface with two surfaces on its respective dispensing die. The dispensing and fiberizing dies have opposed first surfaces with intersecting air passages to connect a source of pressurized air passing through the dispensing die to the fiberizing die slots. In addition, the air and dispensing dies have opposed second surfaces that are operably connected to form the fiberizing slots terminating at a fiberizing die outlet on each side of the dispensing die outlet. The second surface of the fiberizing die has orifices connected to the air passages for porting the pressurized air into the fiberizing die slot and out the fiberizing die outlet.

As disclosed in the above referenced patent application, the fiberizing dies contain precision machined bosses which bear against interfacing surfaces of the dispensing dies to define the fiberizing die slot. Such a construction relies on metal to metal contact to form the required air seal which is difficult and expensive to manufacture and requires a different fiberizing die in order to change the size of the fiberizing die slot. In addition, the fiberizing air is typically routed through the fiberizing dies and enters a wide groove or cavity formed in the first surfaces of the fiberizing dies. The air cavity extends around a corner edge of the dies and across the second surfaces of the fiberizing dies such that the air cavity is contiguous with the fiberizing slots. Consequently, the handling of the pressurized air in a slotted die set is particularly complex and requires fiberizing die components which are difficult and expensive to manufacture.

The fiberizing dies of the above described slotted die set are clamped to the dispensing dies using a single screw or fastener at each end of the die set. Those screws are effective to provide the desired clamping forces at the ends of the dies, but the clamping forces diminish in proportion to the distance moved away from the ends of the die set. For example, at the midpoint of the die set, the clamping forces on the metal-to-metal contacts between the fiberizing and dispensing dies may be insufficient to provide reliable air seals.

In the above described noncontacting slotted die set, a slotted dispensing shim is located between opposed surfaces of the dispensing dies. The dispensing shim has a longitudinal member which extends the full length of the die outlet. The slotted dispensing shim further includes downward projecting tabs that extend to the die outlet. The slotted dispensing shim in combination with the opposed surfaces of the dispensing dies form the dispensing slots through which the adhesive is discharged. The shim tabs have straight sides which terminate into pointed ends. The straight sides of the tabs are effective to provide coating edges which are sharp and clean; however, when using multi-zone die sets, it is desirable to have the ability to adjust the location of adjacent coating edges.

Many coating applications require that the pressurized air discharged with the adhesive stream be heated. Typically, air is heated on the applicator by passing ambient air through a heater comprised of a generally rectangular manifold which has cartridge heaters extending its full length. The manifold further has air passages drilled both along its length and width which are connected in a desired pattern such that the proper heat exchange takes place as the air moves through the manifold. During the manufacture of the heater it is necessary to seal openings in the surfaces of the heater which were created by drilling the required passages. Typically, 20 to 30 such holes must be filled. Those holes are most often plugged with a commercial plug sold for that purpose. However, such plugs generally require precise machining and special assembly tooling. Further, it is possible that in the manufacturing process, a hole may not be plugged, a wrong hole may be plugged or a hole may be plugged improperly. Further, if the heater requires internal cleaning, removal and replacement of the plugs is time consuming and expensive. Therefore, a heat exchanger of the above construction is relatively expensive to manufacture, difficult to maintain, and may be the source of an inadvertent manufacturing error or unreliable operation.

Different adhesive dispensing processes, for example, straight bead dispensing, swirled bead dispensing and flat stream dispensing have the same general fluid control process. Hot melt adhesive is received by an adhesive manifold from a source; is channeled to a pump attached to the manifold; the pump output is connected to the manifold; and the pump output is distributed within the manifold to either a supply plate or a return plate depending on the applicator operation. From the supply plate, fluid flow is controlled by valves which direct the fluid to dispensing mechanisms. The return plate also has valves mounted thereon the outputs of which merge the fluid flow into a single return line which exits the return plate. However, each different dispensing process uses an adhesive manifold, and supply and return plates that have different adhesive routings which require different patterns of porting interfaces between the adhesive manifold and the supply and return plates. Therefore, it is necessary to use a different set of manifold and supply and return plates for each different dispensing process.

SUMMARY OF THE INVENTION

To overcome the disadvantages described above, the applicator of the present invention provides a noncontacting die set that more reliably conducts and dispenses the fiberizing air; and in addition, the applicator includes an improved heater for heating the fiberizing air. The invention further includes an improved adhesive manifold that may be used with different adhesive dispensers thereby avoiding the necessity of buying different adhesive manifolds for each different process. The components of the fluid applicator of the present invention are less expensive to manufacture, easier to assemble and more reliable.

According to the principles of the present invention and in accordance with the described embodiments, a noncontacting slotted die set for a fluid applicator uses a fiberizing shim between the fiberizing air dies and the adjoining adhesive dispensing dies to form fiberizing air slots. The fiberizing shim has a longitudinal member which extends the full length of the fiberizing die. For multi-zone noncontacting dies, the fiberizing shim also has a plurality of tabs that extend from the longitudinal member to the fiberizing die outlet. The tabs are located at the points on the fiberizing die between air chambers on the fiberizing dies and separate the fiberizing zones, or slots, within the fiberizing die outlet. The fiberizing shim establishes the gap, that is, the thickness of the fiberizing slot, and defines the general volumetric boundaries of the fiberizing slot. Therefore, the fiberizing shim eliminates the need for a boss on the fiberizing die that is otherwise used to obtain the desired gap in the fiberizing slot. Using the fiberizing shim has the advantage of permitting the fiberizing gap to be varied by simply using a fiberizing shim of a different thickness.

In a further embodiment of the invention, air flows directly by internal passages from a first surface on the fiberizing die to an air chamber formed in a second surface on each of the fiberizing dies. The second surface bounds one side of the fiberizing slot. Each of those internal air passages have one end intersecting the first fiberizing die surface at a common location with pressurized air ports on an adjoining dispensing die surface. The second end of each of the air passages intersect an air chamber in the second fiberizing die surface. In another aspect of the invention, the air chambers in the fiberizing dies are supplied with pressurized air from a plurality of air passages intersecting the first surface. That plurality of air passages extend through the fiberizing die to mate with a plurality of pressurized air ports on the adjoining dispensing die surface. Consequently, the manufacturing and machining of the fiberizing die sets of the present invention is greatly simplified, less expensive and the die set operation is more reliable.

In a further embodiment of the invention, clamping members are used to clamp the dispensing dies and dispensing shim together and in addition, to clamp the fiberizing dies and fiberizing shims to their respective dispensing dies. The clamping members clamp the dispensing dies and dispensing shim together by using a plurality of fasteners spaced over the length of the dispensing dies. Those fasteners are located at points on the dispensing dies which are removed from the die slots. In addition, the clamping forces securing the fiberizing shims between the fiberizing dies and the dispensing dies are supplemented by a plurality of set screws located on the clamping members at points that align with the tabs on the fiberizing shim which separate the fiberizing air slots. The screws are tightened against an outer surface of each of the fiberizing dies and are effective to provide consistent and effective clamping forces against the tabs of the fiberizing shims. The clamping members and set screws have the advantage of effectively sealing the fiberizing shims over their full length as well as along the tabs of each of the fiberizing shims between adjacent fiberizing slots.

In a further embodiment of the invention, the tabs on both the adhesive and fiberizing shims have tapered sides. The control over the location of the edges of adjacent coatings is controlled by changing the shape of the tab, for example, the taper on the sides of the tabs. With tabs of different tapers, the edges of adjacent coatings may be brought together with no gap, or, in special applications, with a slight overlap or a slight gap. Therefore, the tapered sides of the tabs have the advantage of providing a more reliable and flexible coating edge control.

According to a further embodiment of the invention, a heat exchanger is provided for heating the pressurized fiberizing air. The heat exchanger uses cartridge heaters that extend longitudinally through the manifold of the heat exchanger. However, drillings through the manifold are limited to drilling across the thickness, that is, the smallest dimension defining the volume of the manifold. Further, the ends of the drilled holes are connected by slots disposed in opposing surfaces of the manifold. A flat high temperature gasket and flat plate is then connected to each of the opposing surfaces thereby providing a closed fluid passage between the ends of the fluid passages connected by the slots. The heat exchanger has more tortuous air passages thereby providing a more effective heat exchange process. A further advantage is realized in that the slots may be used to join the cross drilled passages in several configurations thereby providing different air paths through the heat exchanger each of which has a different heat transfer rate. Therefore, different air flow rates and different temperatures may be utilized for different adhesive streams. In addition, the above construction has the advantage of providing a heat exchanger that is much less expensive to manufacture.

In a still further embodiment, the invention includes a common manifold in which the adhesive passages have dimensions and special relationships that match the dimensions and spacial relationships of adhesive passages in mating supply plates and return plates. Therefore, the same manifold may be utilized when different adhesive processes are to be practiced with the applicator.

BRIEF DESCRIPTION OF THE DRAWINGS

FIG. 2 is a cross sectional view taken along line 2—2 of

FIG. 1 and illustrates the flow of hot melt adhesive and pressurized air through the fluid applicator.

DETAILED DESCRIPTION

Figure 1:
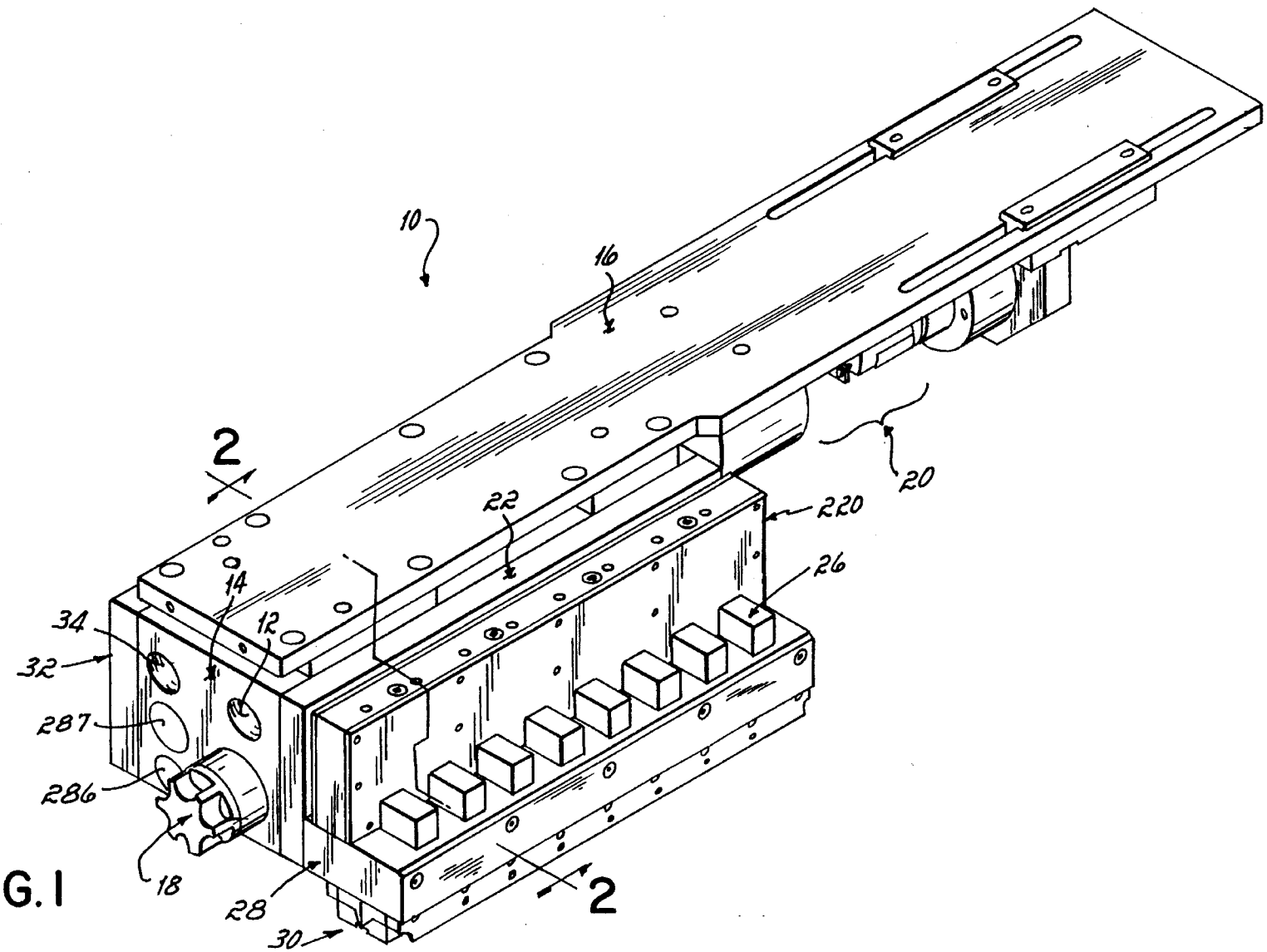
FIG. 1 is an isometric view of a fluid applicator including the multi-zone noncontacting die set of the present invention.

FIG. 1 illustrates a fluid applicator with a multi-zone noncontacting die set for extruding and fiberizing a flat adhesive stream and applying the fiberized adhesive stream as a thin coating to a substrate. The general construction of the applicator 10 is similar to the construction of other hot melt adhesive applicators. An adhesive manifold 14 is connected to a base plate 16; and the manifold 14 has an input 12 connected with a hose or pipe to a source of hot melt adhesive (not shown). The adhesive flows through a filter 18 and into a motor pump unit 20. The pump 20 may be one of several commercially available pumps that can divide a single input stream of hot melt adhesive into a plurality of, for example, eight, metered hot melt adhesive streams. Those eight metered adhesive streams are connected from output orifices of the pump 20 to the manifold 14. During an adhesive dispensing cycle, the eight adhesive streams flow through a supply plate 22 and to a plurality of supply valves 26 mounted on a distribution plate 28. One or more of the supply valves 26 are selectively opened to distribute a metered hot melt adhesive stream flowing therethrough to corresponding zones within a multi-zone noncontacting die set 30 connected to the bottom of the distribution plate 28. When the supply valves 26 are closed, thereby terminating the flow of the adhesive stream therethrough, corresponding return valves (not shown) mounted on return plate 32 are opened. The hot melt adhesive streams then flow through the return valves and merge into a single common return channel. The common return channel connects back to the adhesive manifold 14, and the hot melt adhesive is returned to its supply by flowing through outlet 34 on the adhesive manifold 14.

Figure 2:
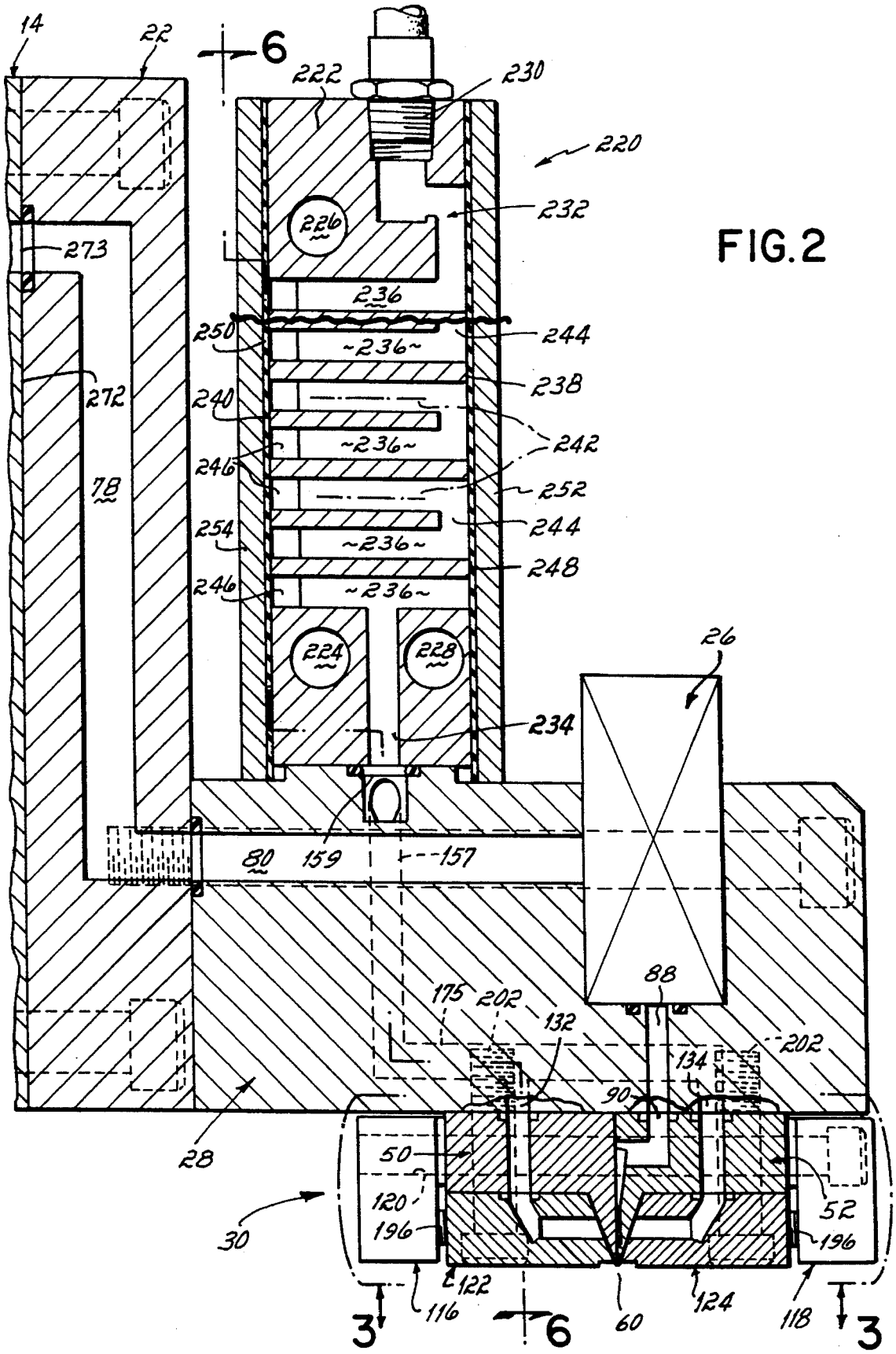
Figure 3:
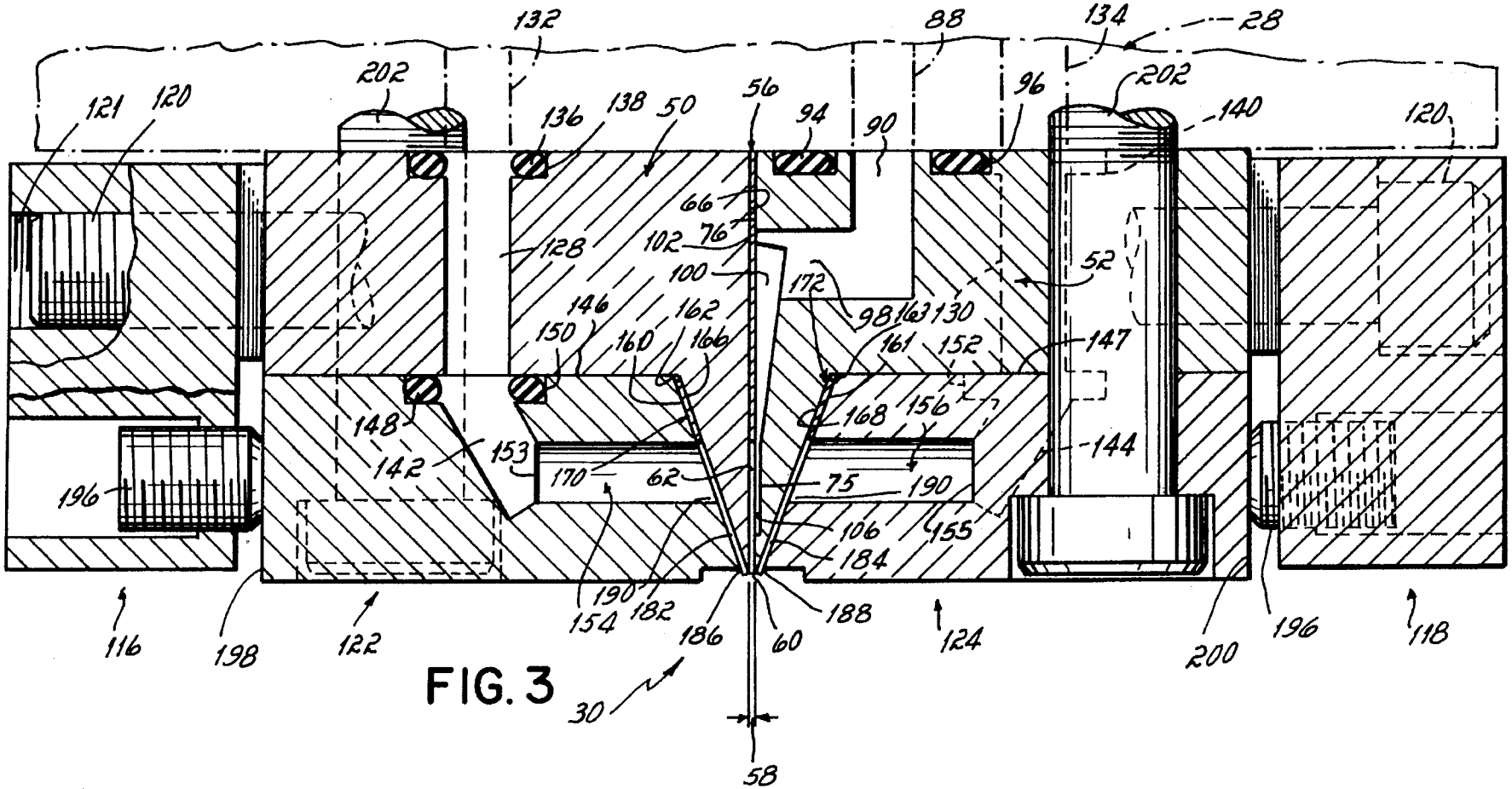
FIG. 3 is a cross sectional view of the area 3—3 within the brackets of FIG. 2 and is an enlarged view illustrating the flow of hot melt adhesive and pressurized air through the die set.
Figure 4:
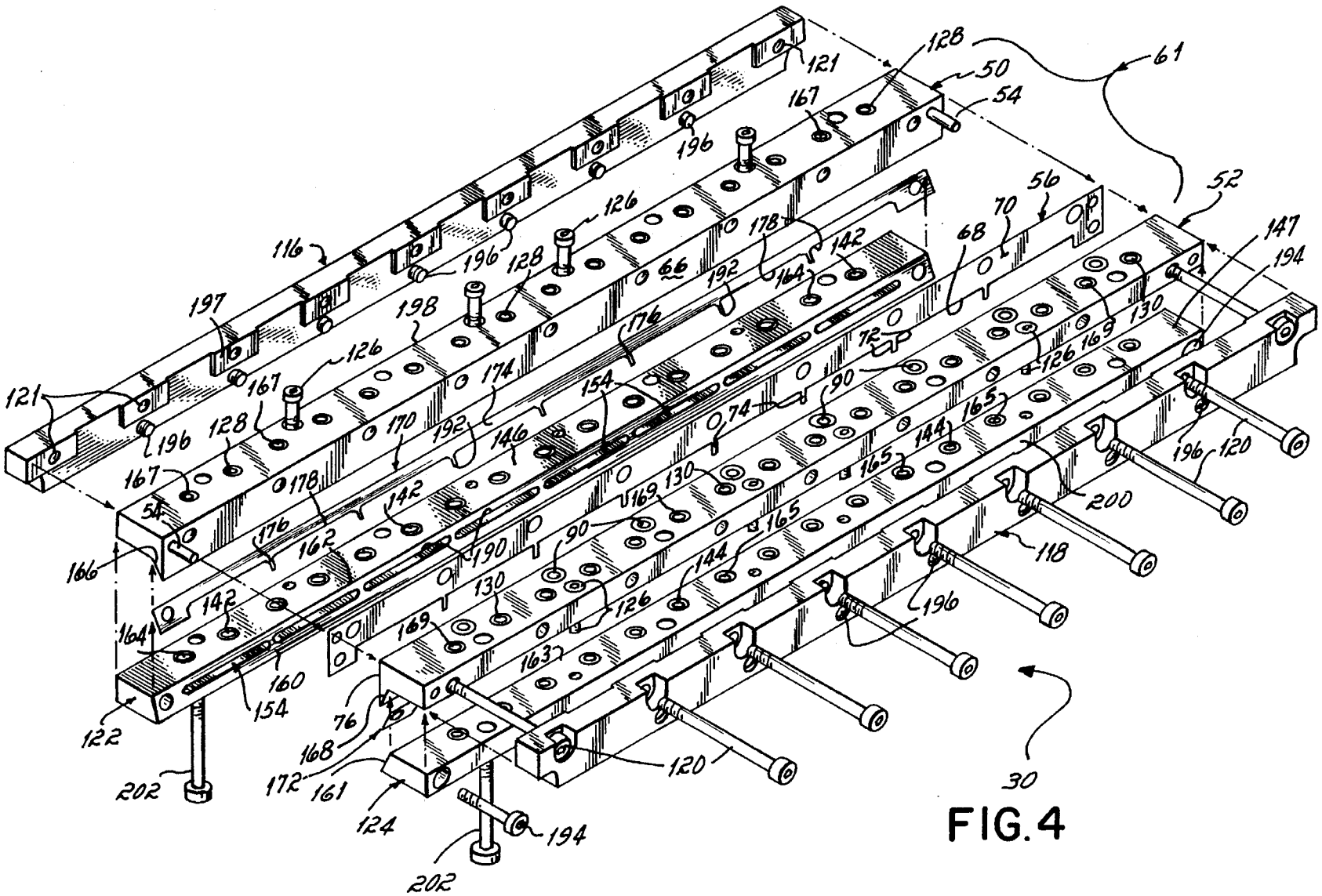
FIG. 4 is an isometric view illustrating the disassembled multi-zone noncontacting die set of the present invention.

The multi-zone noncontacting die set 30 is shown in more detail in FIGS. 2, 3, 4, 5, and 5A. Referring to FIGS. 3 and 4, left adhesive dispensing die 50 is located with respect to a right adhesive dispensing die 52 by locating pins 54. An adhesive dispensing shim 56 is clamped between the adhesive dispensing dies 50, 52 and defines the thickness of the dispensing die gap 58 at the adhesive dispensing die outlet 60. The assembly of the dispensing dies 50, 52 with the dispensing shim 56 functions as an adhesive dispensing die 61 having a plurality of adhesive dispensing zones, or slots, 62 through which the hot melt adhesive is extruded. Each dispensing die slot, or zone, is bounded by a flat surface 66 on the left dispensing die 50, a longitudinal edge 68 of longitudinal member 70 on dispensing shim 56, sides 72 of tabs 74 extending from the longitudinal edge 68 to the dispensing die outlet 60, and a surface 75 (see FIG. 5) on the right adhesive dispensing die 52.

As shown in more detail in FIG. 2, hot melt adhesive from manifold 14, flows through passage 78 of supply plate 22, passage 80 of distribution plate 28, supply valve 26 and through outlet passage 88. The right dispensing die 52 receives the hot melt adhesive through an inlet passage 90 which is connected to the outlet passage 88 in the distribution plate 28. Referring to FIG. 3, O-rings 94 located in annular grooves 96 are effective to provide an adhesive seal at the junction of the right dispensing die 52 and the distribution plate 28. The first adhesive passage 90 intersects one end of a second adhesive passage 98. The other end of the second adhesive passage 98 intersects an adhesive chamber 100 disposed in the surface 76 of the right dispensing die 52.

Figure 5:
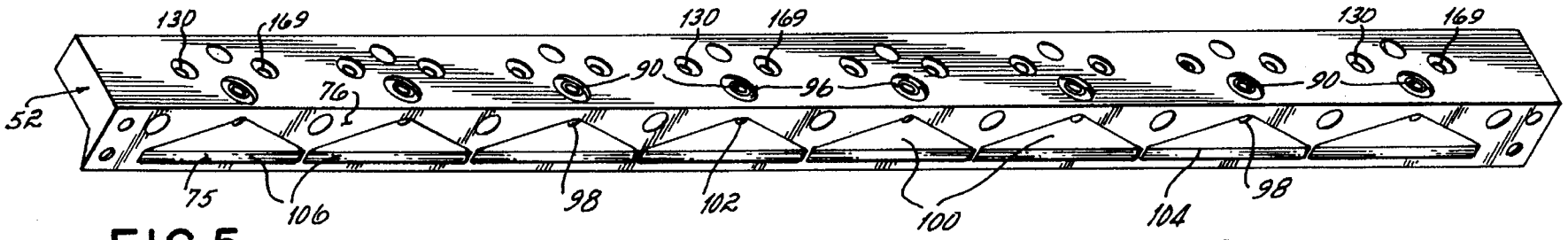
FIG. 5 is an isometric view illustrating the adhesive dispensing die through which the hot melt adhesive flows.
Figure 5A:
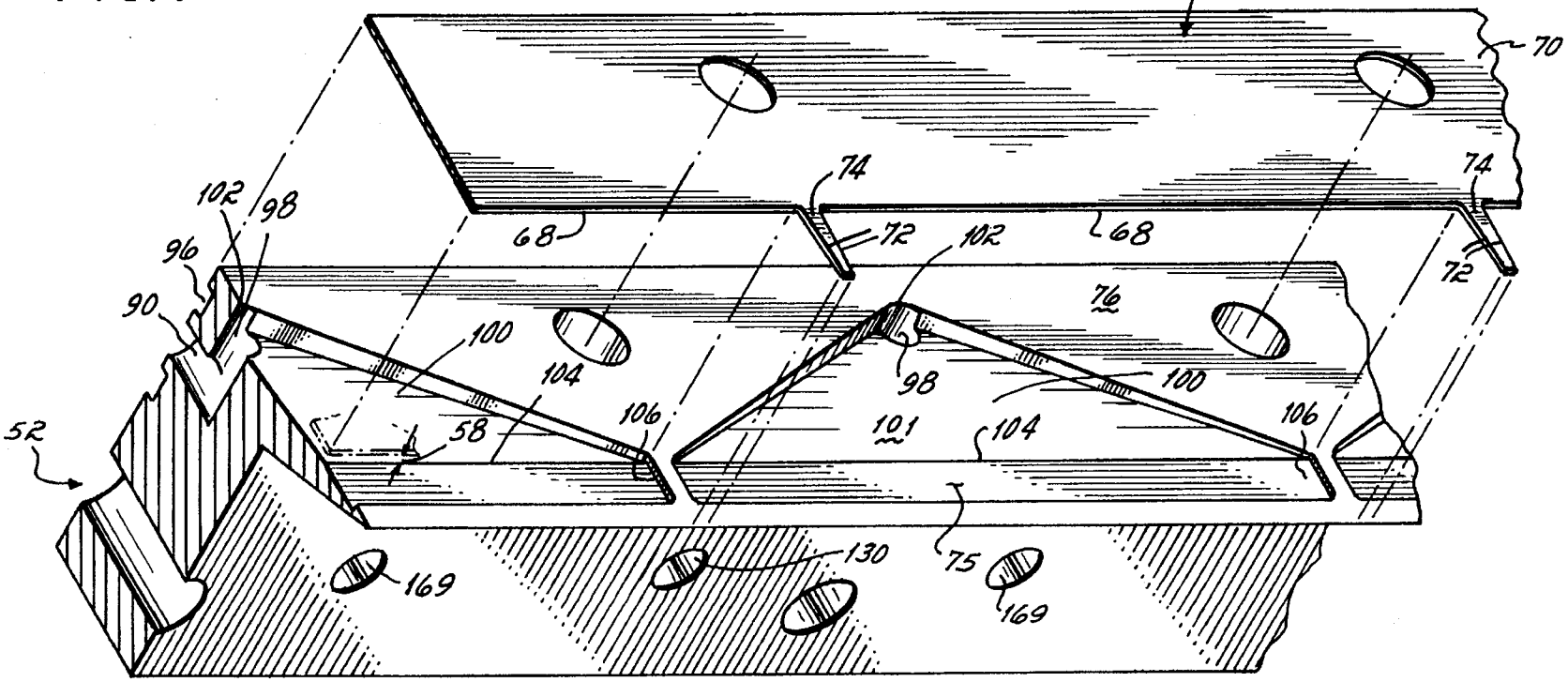
FIG. 5A is an enlarged fragmentary isometric view of the die of FIG. 5, seen from another angle.

Referring to FIGS. 5 and 5A, dispensing die 52 has an adhesive chamber 100 associated with each zone, or slot, in the multi-zone die set 30. All of the adhesive chambers are identical, and each chamber 100 is generally triangularly shaped with the second adhesive passage 98 intersecting the adhesive chamber 100 at the apex 102 of the triangular shape. Further, the side 104 of the triangular volume opposite the apex 102 intersects and forms a longitudinal side of a generally rectangularly shaped adhesive slot 106. The hot melt adhesive flows through passage 90, the second adhesive passage 98, the triangular adhesive chamber 100, and then into the rectangular adhesive slot 106. It is important that the adhesive flow be approximately constant across the side 104 of the triangular adhesive chamber 100 into the adhesive slot 106. Therefore, the triangular adhesive chamber 100 has a variable depth with the greatest depth at the apex 102. Therefore, as the adhesive flows from the apex 102 to the opposite side 104, it is flowing through an approximately constant cross sectional area which results in an approximately constant flow over the length of the side 104 of the chamber 100. The generally rectangular adhesive slot 106 is contiguous with and provides the supply of hot melt adhesive to the adhesive dispensing zone, or slot 62. Consequently, the adhesive is discharged from the adhesive dispensing die outlet 60 as a continuous flat stream. The thickness of the stream is defined by the thickness of the adhesive dispensing shim 56, and the width of the stream is defined by the distance between the sides 72 of adjacent tabs 74 which is the width of the dispensing slot, or zone 62. For example, depending on the application, the adhesive dispensing shim may be in a range of approximately 0.002 inches to 0.006 inches. The distance between opposing sides 72 of adjacent tabs 74, that is, the length of the slot 106 is just under 2 inches. The width of the tabs, that is, the distance between rectangular slots 106 is approximately 0.040 inches. The rectangular slot 106 is approximately 0.010 inches deep and approximately 0.200 inches wide. The rearward surface 101 of the adhesive chamber 100 tapers at an angle of approximately 7° from the surface 75 to the apex 102. The adhesive dispensing dies 50,52 are approximately 17 inches long and accommodate eight adhesive chambers 100 over their length.

As shown in FIG. 4, the dispensing dies 50, 52 and the dispensing shim 56 are clamped together by left and right clamp members 116, 118, respectively. Fasteners 120, for example screws or bolts, extend through the right clamp member 118, the right dispensing die 52, the dispensing shim 56, the left dispensing die 50, and are secured in threaded holes 121 in the left clamp member 116. A plurality of fasteners 120 are located longitudinally along the dispensing dies 50, 52 to provide a constant and sufficient dispensing shim clamping force over the full length of the dispensing dies 50, 52.

The left and right fiberizing dies 122, 124 are identical in construction. Referring to FIG. 3, the fiberizing dies 122, 124 have first surfaces 146,147 connecting to opposed surfaces on the respective dispensing dies 50,52 by fasteners 126 shown in FIG. 4. Further, the first surfaces 146,147 intersect respective second surfaces 160,161 to form respective corners 162, 163 on the respective fiberizing dies 122, 124. The fiberizing dies 122, 124 have respective air chambers 154, 156 disposed into the respective second surfaces 160, 161. In the case of the multi-zone die set of the present invention, each of the fiberizing dies 122, 124 has a plurality of respective air chambers 154, 156. For example, each of the fiberizing dies is approximately 17 inches long with eight air chambers disposed along their length. All of the air chambers 154, 156 in the respective fiberizing dies 122, 124 are identical and are approximately rectangularly shaped. The length of the air chambers 154, 156 is approximately the same as the length of the corresponding adhesive slot 106, that is, just under two inches. However, depending on the application, the length of the air chambers 154, 156 may be slightly shorter, equal to, or slightly longer than its corresponding adhesive chamber 100. The width of each of the air chambers is approximately 0.125 inches, and the air chambers 154,156 have respective closed ends 153,155 at a depth of approximately 0.350 inches as measured along the centerline of the air chambers.

The mechanisms by which heated air from the heater is supplied to each of the air chambers in each of the fiberizing dies 122, 124 are similar, and therefore, the supply of heated air to only one pair of air chambers will be described. The closed ends 153,155 of respective air chambers 154, 156 intersect one end of first fiberizing air passages 142, 144. The other end of the first fiberizing air passages 142, 144 intersect the respective first surfaces 146, 147 and connect with first dispensing die air passages 128, 130 located in the respective dispensing dies 50, 52. O-rings 148 located in grooves 150, 152 provide an air tight seal at the junction between the first surfaces 146, 147 of the fiberizing dies 122, 124 and the opposed surfaces on the respective dispensing dies 50, 52. The first dispensing die air passages 128, 130 are in turn connected to first air supply passages 132, 134 in the distribution plate 28. O-rings 136 located in grooves 138, 140 are effective to provide an air seal between the dispensing dies 50, 52 and the distribution plate 28. As shown in FIG. 2, the air supply passages 132, 134 connect with a first air distribution passage 157 which terminates at an air inlet 159 in the distribution plate 28.

Referring to FIG. 4, preferably, utilizing a construction similar to that described above, each of the air chambers 154, 156 has second fiberizing air passages 164, 165 in respective fiberizing dies 122, 124 extending between the closed ends of the air chambers 154, 156 and respective first surfaces 146, 147. The second fiberizing air passages 164, 165 are connected to second dispensing die passages 167, 169 which in turn are connected with second air supply passages in distribution plate 28, one of which is shown as a second air supply passage 171 in FIG. 6. As further shown in FIG. 6, the second air supply passage 171 intersects with and is supplied heated air by a second air distribution passage 173 which connects with the air inlet 159 in the distribution block 128. The first and second air distribution passages 157, 173 split from the air inlet 159 and extend around the sides of the hot melt adhesive channels 80 also running through the distribution plate 28. As shown in FIG. 2, the first air distribution passage 157 has a leg 175 that extends through the distribution plate 28 to supply heated air through the first air supply passages 134, through the first dispensing die air passage 130, through the fiberizing air passage 144 and into the right air chamber 156. In a similar manner, the second air distribution passage 173 (FIG. 6) has a leg 177 that extends through the distribution plate 28 to supply heated air through air supply passages (not shown) in distribution plate 28 through the second dispensing die air passages 169 (FIG. 4), through second fiberizing air passages 165 and into the right air chamber 156.

Referring to FIGS. 3 and 4, the second surfaces 160, 161 of the left and right fiberizing air dies 122, 124 are located opposite smooth flat outer directed surfaces 166, 168 of respective dispensing dies 50, 52. A first fiberizing air shim 170 is located between surfaces 160 and 166, and a second fiberizing air shim 172 is located between surfaces 164 and 168. The fiberizing shims 170, 172 are identical in construction, and the details of their construction will be described with respect to shim 170. A longitudinal member 174 has a longitudinal edge 178 which is connected to one end of a plurality of tabs, or projections, 176. The tabs 176 extend across the surface 160 between the ends of adjacent air chambers 160. Consequently, a left fiberizing zone, or slot 182 located on one side of the dispensing die outlet is bounded by the orifice, or opening, of the air chamber 154, a portion of the second surface 160 of the fiberizing die 122, the longitudinal edge 178 and sides of the tabs 176 on the fiberizing shim 174 and the opposed outer directed die surface 166 of dispensing die 50. A right fiberizing zone, or slot, 184 located on the other side of the dispensing die outlet is bounded by the orifice, or opening, of the air chamber 156, a portion of the second surface 161 on the fiberizing die 124, a longitudinal edge and sides of tabs on the fiberizing shim 172, and the opposed outer directed surface 168 on the dispensing die 52. The left and right fiberizing zones, or slots, 182, 184 are contiguous with the respective left and right fiberizing air outlets 186, 188. Fiberizing air is supplied to the fiberizing air slots 184, 186 by respective air chambers 154, 156 such that a continuous flat film of air is evenly and continuously dispensed from the fiberized air outlets 186, 188. The upper longitudinal sides 190 of the air chamber 154 are approximately adjacent with the longitudinal edge 178 of the fiberizing shim 170. The upper longitudinal sides of air chambers 156 have the same relationship to the fiberizing shim 172. Further, the free ends 192 of the tabs 176 extend to the respective one of the fiberizing air outlets 186, 188; the free ends 192 have an edge approximately parallel to the longitudinal edge 178.

As shown in FIG. 4, the ends of the left and right fiberizing dies 122, 124 are held together by fasteners 194 which are mounted in the right fiberizing die 124 and threaded into the left fiberizing air die 122. In addition, set screws 196 are threaded through the clamp members 116, 118. The set screws 196 extend through and past the pads, or bosses, 197 projecting from inner directed surfaces of each of the clamp members 116, 118. The set screws 196 bear against the outer directed sides 198, 200 of the respective fiberizing dies 122, 124. The set screws 196 are located to bear against the fiberizing dies 122, 124 at predetermined points adjacent to the tabs 176 on the fiberizing shims 170, 172. Therefore, the set screws provide a constant and sufficient force to clamp the fiberizing shims 170, 172 between the fiberizing dies 122, 124 and their respective dispensing dies 50, 52. Fasteners 202 are used to attach the die set 30 to the distribution plate 28.

In use, one or more of the control valves 26 is opened to provide one or more hot melt adhesive streams through the distribution plate 28, through the right dispensing die 52 and into respective dispensing zones, or slots, 62. The adhesive flows through those zones and is extruded through the die outlet 60 as one or more continuous flat thin strips of adhesive. Simultaneously, heated pressurized air is channeled through the distribution plate 28, the dispensing dies 50, 52, respective fiberizing dies 122, 124, and into fiberizing zones, or slots 182, 184. The heated pressurized air is extruded through the fiberizing die outlets 186, 188 which are located adjacent to and on each side of the dispensing die outlet 60. As with the adhesive, the air is extruded as a continuous flat film which is uniform over the length of the fiberizing outlets 186, 188. The fiberizing air impinges on and operates to tear or separate the continuous thin strip(s) of adhesive being dispensed from the dispensing die outlet 60. The result is a discontinuous or fiberized thin strip(s) of hot melt adhesive which is then applied as a generally rectangular strip to a substrate. The multi-zone noncontacting die set 30 of the present invention has the advantage of applying the adhesive uniformly across the strip and along the edges of the strip. Further, the applied adhesive strip has very sharp, well-defined starting and stopping edges, as well as side edges.

In another aspect of the invention, edge control over the applied adhesive strips is provided by the shape of the tabs 74, 176 of the respective dispensing shim 56 and the fiberizing shims 170, 172. The tabs on the dispensing and the fiberizing shims are identical; and therefore, only the dispensing shim tabs will be described in detail. As best shown in FIG. 5A, the sides 72 of the tabs 74 taper from the longitudinal edge 68 to the dispensing die outlet 60. For example, the width of the tab, that is the distance between its sides, at the longitudinal edge 68 is approximately 0.050". The width of the tabs 74 at the die outlet 60 are approximately 0.030". The taper formed by the sides 72 of the tabs 74, as well as other parameters, may be varied to adjust the edges between adjacent strips such that there is no gap between the strips. In special applications, the taper may be adjusted to provide a small overlap of the edges of adjacent strips or a small gap. As shown in FIG. 5A, the ends of the tabs have a flat edge approximately parallel to the longitudinal edge of the shim. The length of the flat edge will be a function of the length of the dispensing slot, the degree of taper and the application parameters, for example, the distance of the applicator from the substrate. However, a less pointed and flatter edge is more rugged and durable.

Figure 6:
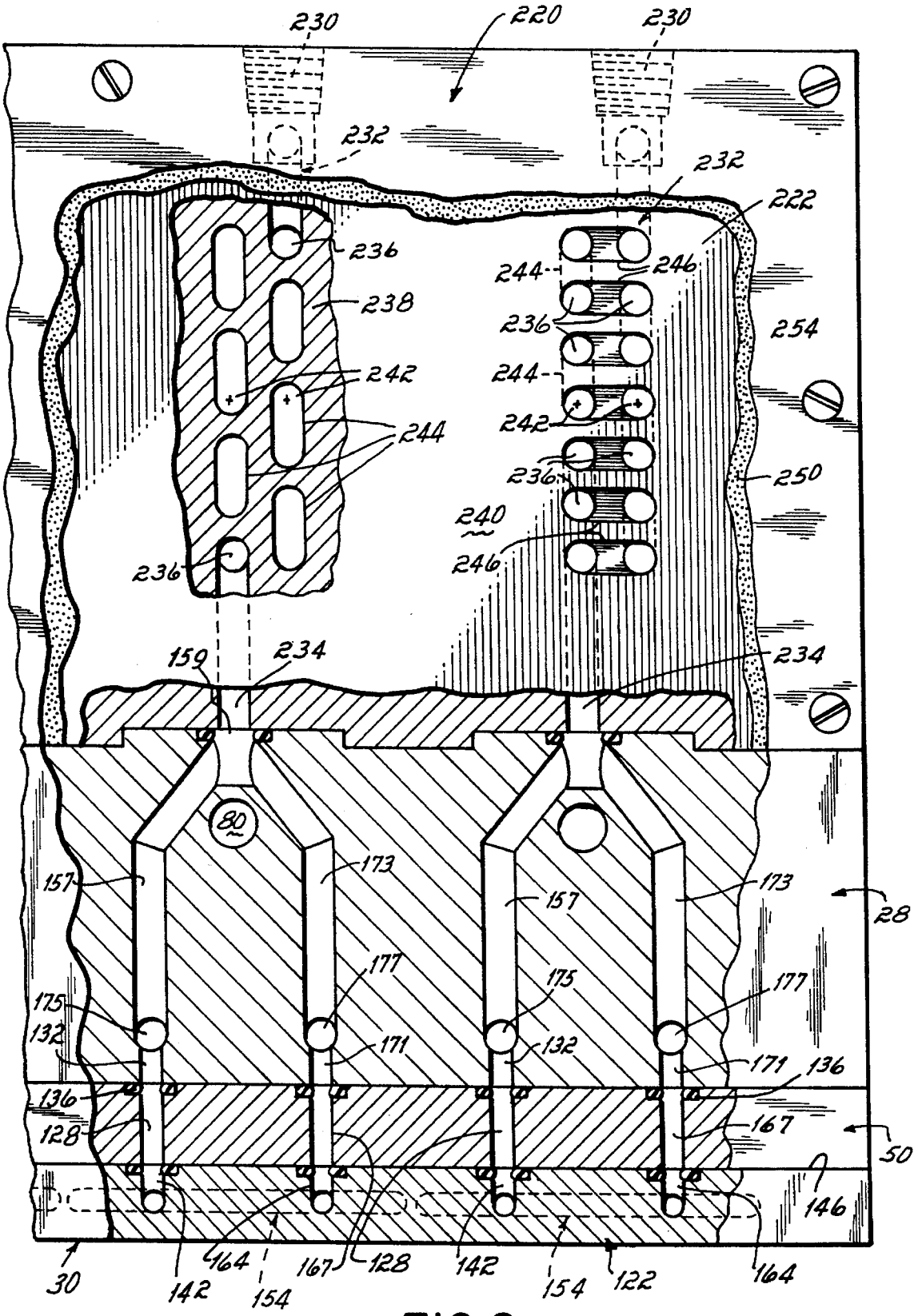
FIG. 6 is a partial cross sectional longitudinal view taken along lines 6—6 of FIG. 2 and illustrates the construction of the air passages within the heater, the distribution plate, and the die set of the present invention.

Referring to FIGS. 2 and 6, an improved heater is provided for heating the pressurized air. The heater 220 has a generally rectangular manifold block 222. Cartridge heaters 224, 226 are located on opposite sides of the manifold block 222 and extend longitudinally through the manifold 222 over its full length. For a clearer illustration, heater 226 and inlet 230 are shown in a different cross-section. A resistance temperature detector 228 is used to provide a feedback signal representing the temperature of the heater manifold block. The manifold contains a number of independent nonintersecting air passages 232 which typically corresponds to the number of hot melt adhesive streams being dispensed by the applicator. All of the independent air passages are identical, and therefore, only one such passage 232 will be described in detail. Air is supplied to an inlet 230 by a hose or pipe connected at one end to the inlet 230 and connected at the other end to a source of pressurized air (not shown). The air passage 232 extends between the inlet 230 and an air outlet 234. The manifold 222 is manufactured such that the air passage 232 is comprised in part of a plurality of short parallel through holes 236 that intersect opposite surfaces 238, 240 that are separated by the thickness of the manifold 222. By definition, the thickness is the length of the smallest side of a rectangular volume. In the present embodiment, the general direction of the air passage 232 extends across the width of the manifold 222 which is approximately perpendicular to the center lines 242 of the through holes 236.

As shown in FIG. 6, the through holes 236 are arranged in two rows, and their center lines 242 define a locus of points which lie in two approximately parallel lines extending across the width of the manifold 222. Selected throughholes 236 are interconnected by first vertical slots 244 which are milled or otherwise disposed through the surface 238 of the manifold 222. The first slots 244 connect alternative pairs of through holes 236 to form U-shaped channels in each of the rows of through holes extending across the width of the manifold 222. Further, second horizontal slots 246 are milled or otherwise disposed in the surface 240 and are effective to interconnect ends of selected U-channels in one row with an adjacent ends of U-channels in the other row. Therefore, the through holes 236 and slots 244, 246 form a continuous channel between the inlet 230 and outlet 234 across the width of the manifold 222. Gaskets 248, 250 made from a high temperature material, for example, silicone, and side plates 252, 254 are connected to the surfaces 238, 240 of the manifold 222. The plates 252, 254 cover the slots 244, 246 in the respective surfaces 238, 240 to provide closed passages connecting the ends of the through holes which are joined by the slots. Consequently, a closed air-tight path is provided between the inlet 230 and outlet 234.

In use, the manifold of the present invention provides a tortuous path between the inlet 230 and outlet 234 for maximum heat transfer. Further, the through holes 236 and interconnecting slots 244, 246 may be varied to provide different air flow configurations for different air streams thereby varying the temperature to which individual air streams are heated. In addition, the use of the drilled through holes 232 and interconnecting slots 244, 246 provides a relatively simple construction which may be more quickly and less expensively manufactured.

Figure 7:
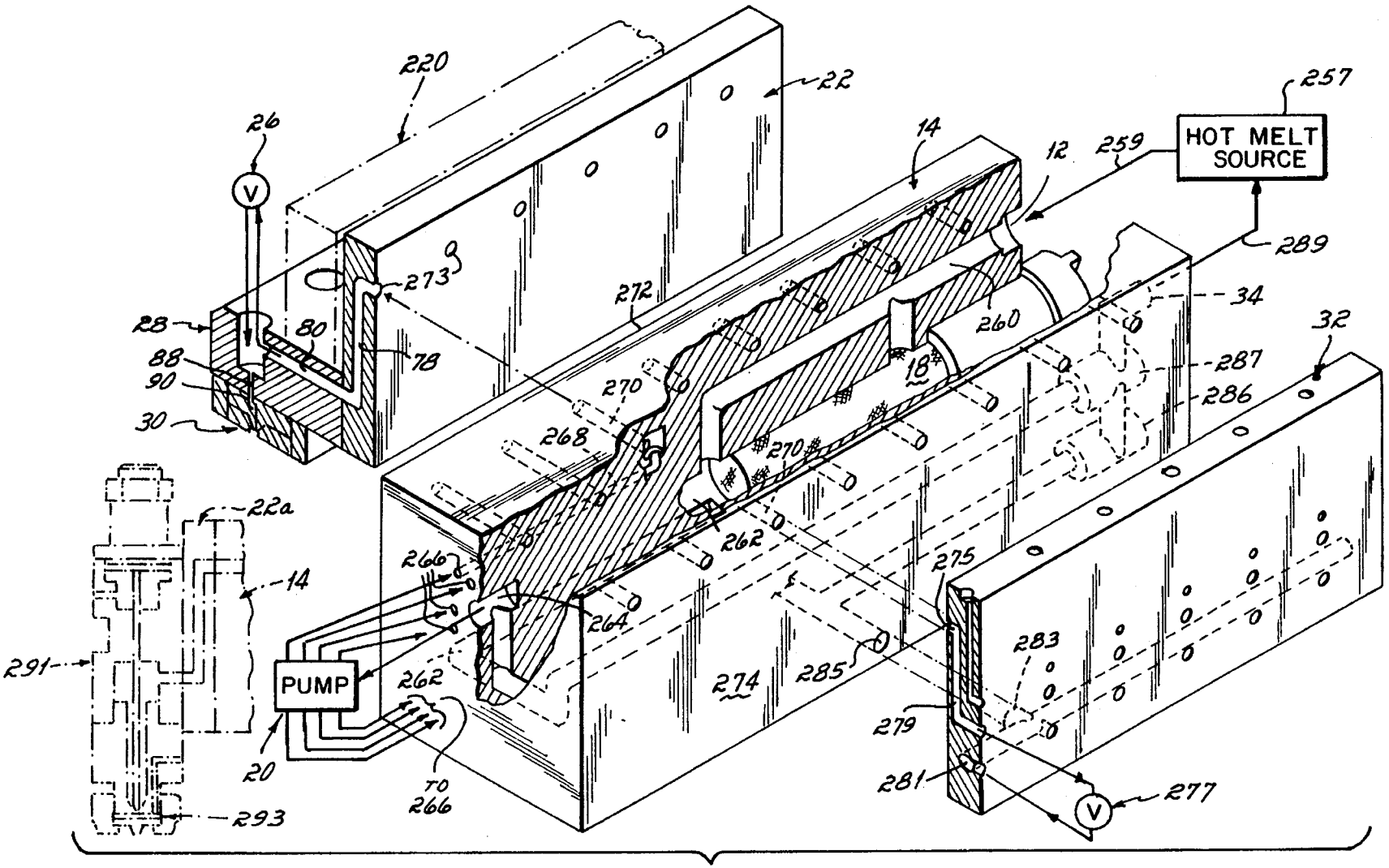
FIG. 7 is a schematic isometric view, in partial cross-section, of the adhesive distribution manifold of the present invention and associated return plate and supply plates operably connected therewith.

In a further embodiment, the invention provides a universal adhesive manifold 14 which is illustrated in detail in FIG. 7. A source of hot melt adhesive 257 is supplied by means of a hose or pipe 259 to an adhesive input 12 on the manifold 14. The adhesive is conducted along supply channel 260 through a filter 18 and then through channel 262 to an inlet 264 of pump 20. The pump returns the hot melt adhesive as a plurality of, for example, eight, metered adhesive streams which are input to the adhesive manifold 14 at ports 266. Each of the ports 266 is connected to a longitudinal channel 268 which intersects a selected one of a plurality of cross channels 270. The cross channels 270 are approximately perpendicular to the longitudinal channels 268. The cross channels 270 intersect opposing surfaces 272 and 274 of the manifold 14.

The surface 272 of the manifold 222 interfaces with and provides hot melt adhesive to input ports 273 on supply plate 22 which mate with the channels 270. Similarly, the surface 274 interfaces with a surface on the return plate 32 which has adhesive ports 275 that mate with the ports 270 intersecting surface 274. During a dispensing cycle, return valves, for example, return valve 277, on the return plate 32 are closed thereby blocking flow through the return plate 32; and supply valves 26 on the supply plate 22 are open thereby permitting adhesive flow through the cross channels 270 and through ports 273 in the supply plate 22. The hot melt adhesive flow through open control valves 26 and out of the fluid applicator, for example, the multi-zone noncontacting fluid applicator 30. At the end of a dispensing cycle, the control valves 26 on the supply plate 22 are closed; and corresponding control valves 277 on the return plate 32 are opened. Therefore, hot melt adhesive flows through the cross channel 270 to the surface 274 and into port 275 of the return plate 32. The hot melt adhesive flows through channel 279, the open return valve 277 and into a common line 281 which exits the return plate at port 283 mating with the return chamber 285 in surface 274 of manifold 222. The hot melt adhesive in the return channel 285 flows past a process back pressure valve 286, bypasses a pump back pressure valve 287 and intersects outlet 34 which is connected to a pipe or a hose back 289 to the source of hot melt adhesive 257. The pump back pressure valve 287 is used to elevate the pressure at the pump inlet 264 to a pressure that is above the minimum pressure of the pump 20 to prevent cavitation. The process back pressure valve 286 is set so that the return line pressure is equal to the supply line pressure when fluid is being dispensed. Therefore, at the end of the dispensing cycle, adhesive flow is switched from the supply valve 26 to the return valve 277 at an approximately constant pressure.

The manifold 14 is designed such that the ports 270 in the opposing surfaces 272, 274 mate with ports 273, 275 in the supply plate 22 and return plate 32. Therefore, in use, the supply plate 22 and return plate 32 may be connected to either of the surfaces 272, 274. Further, as shown in phantom in FIG. 7, a supply plate **22*a* which contains supply valves 291 and a swirled bead dispensing head 293 may also be connected to the same adhesive distribution manifold 14. Other supply plates which are adapted for use with other different adhesive dispensing processes are also designed to mate with the porting in either of surfaces 272, 274. Therefore, the manifold 14** may be used to supply a plurality of adhesive streams to any selected one of a plurality of supply plates associated with different adhesive dispensing processes.

While the present invention has been set forth by description of the embodiments in considerable detail, it is not intended to restrict or in any way limit the claims to such detail. Additional advantages and modifications will readily appear to those who are skilled in the art. For example, the clamp members 116, 118 of the die set may be implemented on a die set having a single zone or slot, or the clamp members 116, 118 may be used to clamp a pair of dispensing dies that are used on a nonfiberizing die set which does not require the pair of fiberizing dies. Further, the set screws 196 may be replaced by fixed or adjustable pins or any other devices that is effective to apply sealing forces at different longitudinal points along the length of the fiberizing dies.

In addition, the cartridge heaters 224, 226 of the heater 220 may be replaced by chillers or other mechanisms for removing heat from the manifold 222. In that application, heat is removed from the air passing through the manifold 222 thereby cooling the air. Therefore, the heater 220 may be more generally referred to as a heat exchanger.

The invention in its broadest aspects is therefore not limited to the specific details shown and described. Accordingly, departures may be made from such details without departing from the spirit and scope of the invention.

What is claimed is:

1. An apparatus for applying a fiberized fluid coating to a substrate comprising:

a dispensing die having a dispensing die outlet through which a fluid is dispensed;

a pair of fiberizing dies connected to the dispensing die to form a -fiberizing die outlet on each side of the dispensing die outlet; and a pair of shims, each shim located between one surface on one of the fiberizing dies and an adjacent surface on the dispensing die, and each shim including a longitudinal element extending along a length of a respective fiberizing die, and a plurality of tabs substantially perpendicular to the longitudinal element, each tab having a first end connected to a longitudinal edge of the longitudinal element and having a second end extending to the fiberizing die outlet.

2. The apparatus of claim 2 wherein each of the fiberizing dies, a respective shim and the dispensing die form a plurality of air slots contiguous with the fiberizing die outlet.

3. The apparatus of claim 2 wherein each of the fiberizing dies has a plurality of chambers on a first surface in contact with a side surface of a respective shim, each of the plurality of chambers intersecting one of the plurality of air slots.

4. The apparatus of claim 1 wherein each of the plurality of tabs having side edges proximate ends of adjacent ones of the plurality of chambers, the side edges of each of the plurality of tabs being tapered from one end toward an opposite end of the tabs.

5. The apparatus of claim 4 wherein the opposite ends of the plurality of tabs having an edge approximately parallel to the longitudinal element

6. An apparatus for producing a plurality of adjacent fiberized fluid streams and applying the plurality of fiberized fluid streams to a substrate comprising:

a dispensing die having a plurality of dispensing slots arranged end to end along a dispensing die outlet and dispensing a plurality of fluid streams; and a pair of fiberizing dies, each of the fiberizing dies being operably connected to the dispensing die to form a plurality of fiberizing slots arranged end to end along a fiberizing die outlet, each of the fiberizing slots being adjacent to and on one side of one of the dispensing slots, the fiberizing slots dispensing a fiberizing fluid for impinging upon and fiberizing the plurality of fluid streams, each of the fiberizing dies further comprising a first surface forming one side of the fiberizing slots, the first surface having a plurality of chambers, each of the plurality of chambers being proximate to and contiguous with one of the fiberizing slots, a second surface intersecting the first surface to form a corner of the fiberizing die, a supply passage having one end intersecting the second surface, and an internal passage having a first end intersecting the chamber and a second end intersecting an opposite end of the supply passage.

7. The apparatus of claim 6 wherein each of the fiberizing dies further comprising:

at least two supply passages, each supply passage having one end intersecting the second surface; and at least two internal passages, each internal passage having a first end intersecting the chamber and a second end intersecting an opposite end of one of the supply passages.

8. An apparatus for fiberizing and applying a plurality of adjacent fluid streams to a substrate comprising:

a pair of adjacent dispensing dies forming a dispensing die outlet therebetween;

a dispensing shim located between the pair of dispensing dies;

a pair of fiberizing dies operably attached to the pair of dispensing dies to form a fiberizing die outlet on each side of the dispensing die outlet;

a pair of clamp members, each of the clamp members clamping one of the fiberizing dies to one of the dispensing dies;

at least one fastening element mounted in one of the clamping members, extending through the dispensing dies and the dispensing shim and is connecting to another of the clamping members for securing the pair of dispensing dies between the clamping members, thereby clamping the dispensing shim between the dispensing dies.

9. The apparatus of claim 8 further comprising means operably coupled with each of the clamping members for applying forces at predetermined points on a respective one of the fiberizing dies.

10. An apparatus for fiberizing and applying a plurality of adjacent fluid streams onto a substrate comprising:

a pair of adjacent dispensing dies forming a dispensing die outlet having a plurality of dispensing slots;

a pair of fiberizing dies operably attached to the pair of dispensing dies to form a fiberizing die outlet between each of the fiberizing dies and a respective one of the dispensing dies, each of the fiberizing die outlets including a plurality of fiberizing slots;

a pair of clamp members, each clamp member clamping one of the fiberizing dies to one of the dispensing dies;

at least one fastening element mounted in one of the clamp members for securing the one of the clamp members to one of the dispensing dies; and means operably coupled with each of the clamp members for applying forces at predetermined points on a respective one of the fiberizing dies.

11. The apparatus of claim 10 wherein each of the clamp members includes a plurality of fastening elements for securing the pair of clamp members to the pair of dispensing dies.

12. The apparatus of claim 11 wherein the means for applying forces are located on the clamp members adjacent the predetermined points.

13. The apparatus of claim 12 wherein the means for applying forces further comprises a plurality of screws threadedly engaged in each of the clamp members at points on the clamp members adjacent the predetermined points, each of the screws bearing against the one of the fiberizing dies at one of the predetermined points.

14. The apparatus of claim 13 further comprising a pair of shims, each located between one of the fiberizing dies and a respective one of the dispensing dies thereby forming the fiberizing die outlet and the means for applying forces pushes the respective one of the fiberizing dies against its respective shim, thereby clamping the shim tightly between the one of the fiberizing dies and its respective dispensing die.

15. The apparatus of claim 10 wherein the predetermined points are located on the fiberizing dies between the fiberizing slots.

16. The apparatus of claim 10 further comprising a dispensing shim located between the pair of dispensing dies and wherein the at least one fastening element is mounted in the one of the clamping members, extends through the dispensing dies and the dispensing shim and is connected to another of the clamping members for securing the pair of dispensing dies between the clamping members, thereby clamping the dispensing shim between the dispensing dies.

17. A die for fiberizing and applying a plurality of adjacent fluid streams to a substrate, the die comprising:

a pair of dispensing dies, one of the pair of dispensing dies having a first surface with a plurality of chambers, each of the chambers having an inlet passage; and a shim located between the pair of dispensing dies and adjacent the first surface of the one dispensing die, the shim and the dispensing dies forming a dispensing die outlet having a plurality of dispensing slots corresponding to the plurality of chambers, the shim including a longitudinal member extending over a length of the dispensing die and having a longitudinal edge proximate the inlet passages in the plurality of chambers, and a plurality of tabs, each of the plurality of tabs having one end connected to the longitudinal edge of the longitudinal member and an opposite end extending to the dispensing die outlet, each of the plurality of tabs further having side edges proximate ends of adjacent ones of the plurality of chambers, the side edges of each of the plurality of tabs being tapered from the one end toward the opposite end of each of the tabs.

18. The apparatus of claim 17 wherein the opposite end of each of the plurality of tabs having an edge approximately parallel to the longitudinal edge of the longitudinal member.

* * * * *

UNITED STATES PATENT AND TRADEMARK OFFICE

CERTIFICATE OF CORRECTION

PATENT NO. : 5,458,291
DATED : October 17, 1995
INVENTOR(S) : Paul S. Brusko, et al.

It is certified that error appears in the above-indentified patent and that said Letters Patent is hereby corrected as shown below:

Column 1, line 10, "as thin" should be --as a thin--.

Column 8, line 26, delete "160" and insert --154--.

Column 11, line 16, delete "hose back 289" and insert --hose 289 back--.

<u>In the claims</u>:

In claim 2, column 12, line 15, delete "claim 2" and insert --claim 1--.

In claim 5, column 12, line 29, insert a --.-- (period) after element.

Add claim 19 as follows:

UNITED STATES PATENT AND TRADEMARK OFFICE

CERTIFICATE OF CORRECTION

PATENT NO. : 5,458,291
DATED : October 17, 1995
INVENTOR(S) : Paul S. Brusko, et al.

It is certified that error appears in the above-indentified patent and that said Letters Patent is hereby corrected as shown below:

19. An apparatus for fiberizing a plurality of adjacent hot melt adhesive streams and applying the plurality of adjacent fluid streams to a substrate comprising:

a dispensing die shim having a first longitudinal member and a first plurality of tabs extending therefrom;

a pair of dispensing dies operably attached to opposite sides of the dispensing die shim to form a plurality of adhesive dispensing slots bounded by opposing side of the pair of dispensing dies, the first longitudinal member and sides of the first plurality of tabs of the dispensing die shim; the plurality of adhesive dispensing slots being contiguous with an adhesive dispensing die outlet;

a pair of fiberizing shims having a second longitudinal member and a second plurality of tabs a pair of fiberizing dies operably attached with the pair of fiberizing shims to the pair of dispensing dies to form a pair of fiberizing air outlets, each of the pair of fiberizing shims being located between one of the pair of fiberizing dies and one of the pair of dispensing dies to form a fiberizing air die outlet on one side of the dispensing die outlet, each of the pair of fiberizing air die outlets including a plurality of fiberizing die slots, and

UNITED STATES PATENT AND TRADEMARK OFFICE

CERTIFICATE OF CORRECTION

PATENT NO. : 5,458,291
DATED : October 17, 1995
INVENTOR(S) : Paul S. Brusko, et al.

It is certified that error appears in the above-indentified patent and that said Letters Patent is hereby corrected as shown below:

each of the plurality of fiberizing air die slots being bounded by the second longitudinal member, the second plurality of tabs and opposing surfaces of respective ones of the dispensing dies and the fiberizing dies;

a pair of clamp members;

a plurality of fasteners located longitudinally along the pair of clamp members for clamping the dispensing shim between the pair of dispensing dies; and means operably coupled with each of the clamp members for applying forces at longitudinal locations along the pair of fiberizing dies to clamp the pair of fiberizing shims between one of the pair of fiberizing dies and a respective one of the pair of dispensing dies.

Signed and Sealed this

Twentieth Day of August, 1996

Bruce Lehman

*Attest:*

BRUCE LEHMAN

*Attesting Officer*

*Commissioner of Patents and Trademarks*